US006988931B1

(12) United States Patent
Martinet et al.

(10) Patent No.: US 6,988,931 B1
(45) Date of Patent: Jan. 24, 2006

(54) PAD WITH GRADUATED THICKNESS AND VERY THIN NECKLINE AND METHOD FOR MAKING THE SAME

(75) Inventors: Nathalie Martinet, New York, NY (US); Judith Grigor, New York, NY (US)

(73) Assignee: Victoria's Secret Stores, Inc., New York, NY (US)

( * ) Notice: Subject to any disclaimer, the term of this patent is extended or adjusted under 35 U.S.C. 154(b) by 0 days.

(21) Appl. No.: 11/060,091

(22) Filed: Feb. 17, 2005

(51) Int. Cl.
*A41C 3/00* (2006.01)

(52) U.S. Cl. ..... 450/57; 2/267

(58) Field of Classification Search ..... 450/38, 450/39, 54–57, 81, 93; 2/455, 267, 268, 2/463, 92; 623/7, 8; 156/245; 264/257, 264/258, 291, 292, 294, 145, 148, 152–157, 264/160, 163, 554
See application file for complete search history.

(56) References Cited

U.S. PATENT DOCUMENTS

| | | | | | |
|---|---|---|---|---|---|
| 481,788 | A | * | 8/1892 | Goldman | 2/267 |
| 2,190,807 | A | | 2/1940 | Steinberger | |
| 2,702,769 | A | | 2/1955 | Alderfer | |
| 2,727,278 | A | | 12/1955 | Thompson | |
| 2,896,631 | A | | 7/1959 | Block | |
| 3,164,655 | A | | 1/1965 | Howard et al. | |
| 3,280,818 | A | * | 10/1966 | Pankey et al. | 450/81 |
| 3,342,922 | A | | 9/1967 | Karpovich et al. | |
| 3,502,083 | A | | 3/1970 | Howard et al. | |
| 3,534,128 | A | | 10/1970 | Makowski | |
| 3,766,669 | A | | 10/1973 | Pearsall | |
| 3,799,174 | A | | 3/1974 | Howard | |
| 3,934,593 | A | * | 1/1976 | Mellinger | 450/56 |
| 3,939,023 | A | | 2/1976 | Magidson et al. | |
| 6,042,608 | A | | 3/2000 | Ishikawa et al. | |

* cited by examiner

*Primary Examiner*—Gloria M. Hale
(74) *Attorney, Agent, or Firm*—Colucci & Umans; Angelo Notaro; Peter C. Michalos

(57) ABSTRACT

A method for making a pad includes pre-laminating a pair of foam sheets with fabric, shaving the foam from a first end of each foam sheet so that it gradually becomes thinner until only fabric is existent at an opposite second end, attaching the fabric and foam assemblies via the fabric at the second ends to form a pre-form assembly, molding the pre-form assembly to form a pair of cup-shaped members, and trimming off material around the cup-shaped members to form a pair of pads. The method further includes molding a second sheet of fabric, enclosing a formed pad in the second sheet of fabric, and trimming off the second fabric material around the edges of the formed pad. The formed pad is thickest at the bottom for support and becomes thinner until there is only fabric along the neckline to blend in with the skin of the wearer.

12 Claims, 6 Drawing Sheets

FIG. 6
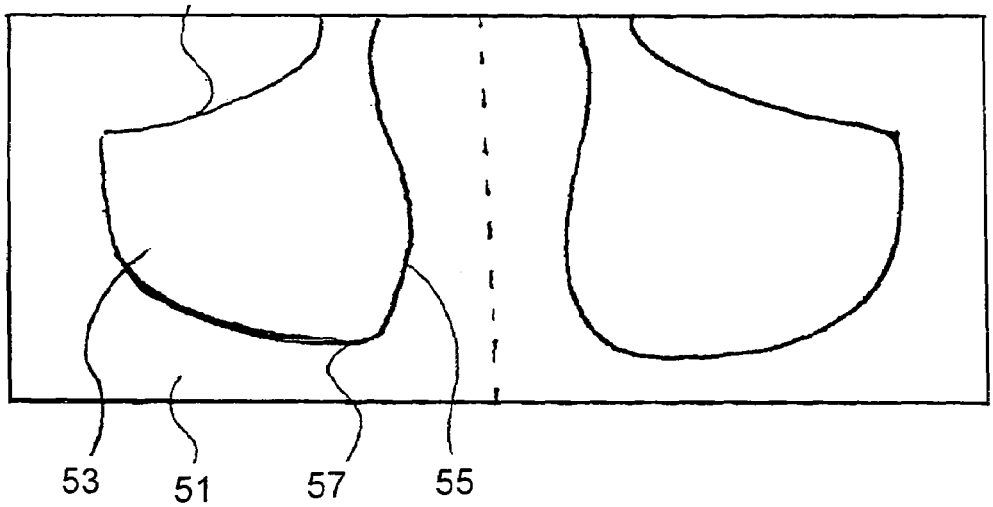
FIG. 7
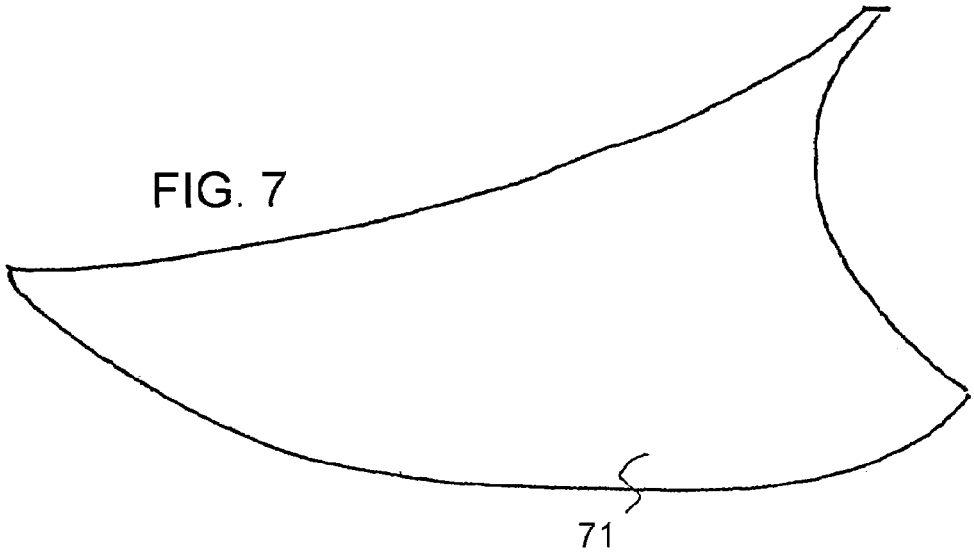
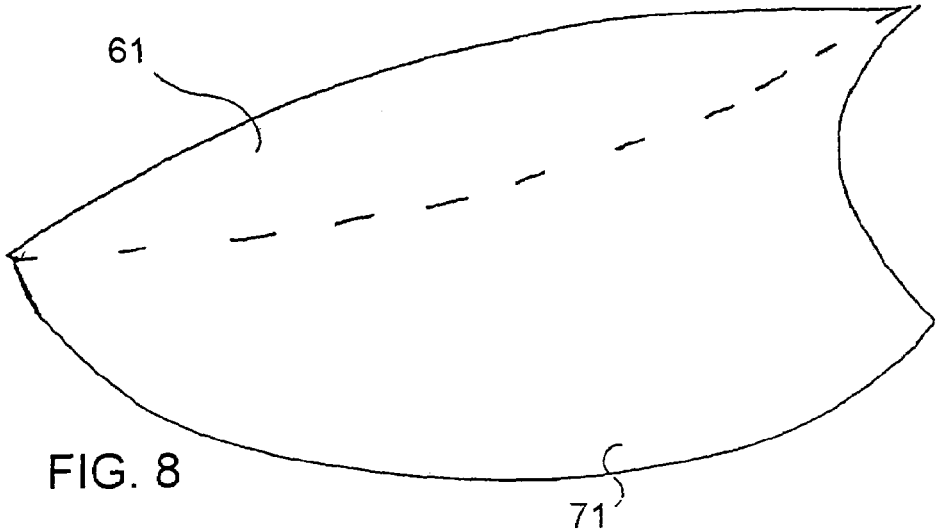
FIG. 8

PAD WITH GRADUATED THICKNESS AND VERY THIN NECKLINE AND METHOD FOR MAKING THE SAME

FIELD AND BACKGROUND OF THE INVENTION

The present invention relates generally to the field of bras and related garments and in particular to a new and useful pad product which gradually thickens from the neckline to the bottom of the cup portion for use in bras, camisoles, slips or any other breast covering garment where padding is desired.

Pads having varying thicknesses and methods for making such pads are known in the art. For example, U.S. Pat. No. 2,896,631 discloses a bra pad of synthetic plastic foam having a thick lower portion which fits beneath the breast and elevates the breast, a downwardly directed flange on the lower edge of the lower portion, and an upper portion which is firmer and thinner than the lower portion. The bra is made by subjecting a flat sheet stock of foam material to heat and pressure in a mold in order to compress the various parts. The breast pad is placed inside a bra cup made of inner and outer layers of cloth.

U.S. Pat. No. 3,164,655 discloses a method of making breast pads with varying thickness. Two blanks having an identical configuration of a cone shape are cut from a block of polyurethane foam and then placed side by side. The blanks are fastened together by adhesive, with their adjacent edges slightly overlapping. The blanks are then placed simultaneously within a mold having male and female portions that form the pattern of a complete bra front. Different portions of the pads are compressed to a greater or lesser degree during the molding operation. The edges of the pad are subjected to greater pressure and the center portions are compressed less in order to provide a softer area of greater thickness. A layer of cloth may be laminated to one or both sides of the blank during the molding operation of the blanks. Excessive material is then trimmed from the edges.

U.S. Pat. No. 3,939,023 discloses a method for making a bra pad having a heavy section on the bottom portion of the pad for providing support to a breast, and a thinner tapered section on the upper portion of the pad so that the pad will blend into the top of the breast.

The process for making the pad includes the steps of folding a blank lengthwise and making a transverse cut, folding over diagonal portions along the transverse cut, and then folding the blank again so that a cone shaped pad is formed so that one end of the cone shaped pad contains the overlapping folded portions and is thus much thicker than the other end. The transition between the thick section and the thinner section is not abrupt because of the tapered edges formed by the transverse cut. The pad is then placed in a mold having the desired contour and is compressed to assume the shape of the mold. The overlapping double layered section remains thicker. In the last step, excess material is trimmed away.

U.S. Pat. No. 3,502,083 discloses a bra pad having a lower portion that is thicker than its upper portion. A vertical cut is made into a blank and opposite sides of the blank are twisted into overlapping relationship deforming the blank from a flat shape to a conical shape and forming a three-quarter pad. The entire lower portion of the pad blank comprises a double layer of material, while the upper portion comprises a single layer of material. The pad blank is then molded to shape in a two-part mold having the shape and contour of the desired finished pad.

There is still a need for a method for providing a bra pad which is thickest at the bottom cup area and which becomes gradually thinner as the neckline is approached, wherein the neckline of the pad blends into the skin. There is a need for providing such a pad in a simple manner without cutting and folding steps or cone-shaped pre-forms.

SUMMARY OF THE INVENTION

It is an object of the present invention to provide a bra pad which is thickest at the bottom cup area and which becomes gradually thinner as the neckline is approached, wherein the neckline of the pad blends into the skin.

It is a further object of the invention to provide a bra pad made in accordance with the method of the invention.

Accordingly, the present invention provides a method for making a pad including the steps of pre-laminating a pair of foam sheets with fabric, shaving the foam from a first end of each foam sheet so that it gradually becomes thinner until only fabric is existent at an opposite second end, attaching the fabric and foam assemblies via the fabric at the second ends to form a pre-form assembly, molding the pre-form assembly under heat to form a pair of cup-shaped members, and trimming off material around the cup-shaped members to form a pair of pads. A stabilizer is glued to the bottom side of the formed pads to provide shape and lift to the pad.

The method further includes molding a pair of second sheets of fabric, enclosing the pads in respective second sheets of fabric, and trimming off the second fabric material around the edges of the pads.

The formed pads are thickest at the bottom for support and become thinner until there is only fabric along the neckline to blend in with the skin of the wearer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 6 is a top view of the formed cup-shaped members after molding;

FIG. 7 is a drawing of the stabilizer;

FIG. 8 is a top view of a formed pad and a dashed line indicating the top edge of the stabilizer when it is affixed to the bottom of the pad;

DESCRIPTION OF THE PREFERRED EMBODIMENTS

Figure 1:
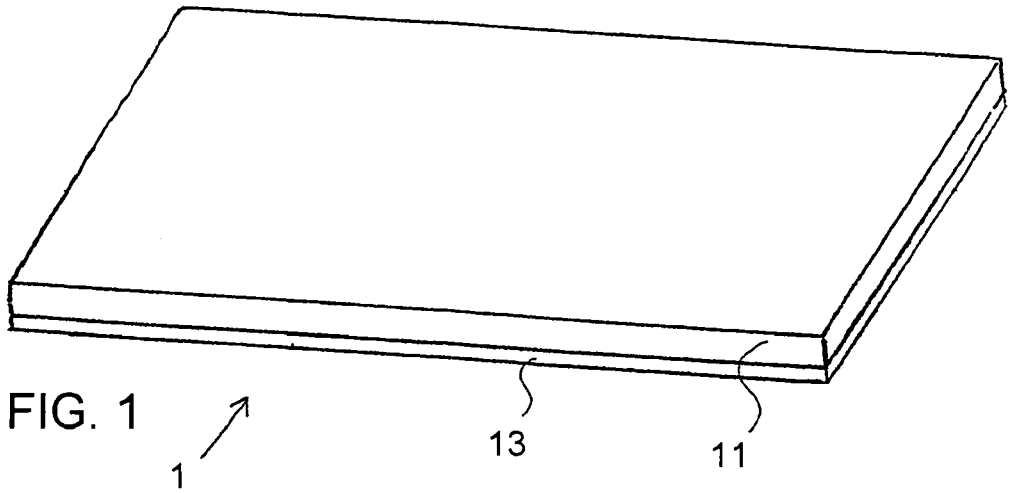
FIG. 1 is a top and front perspective view of a laminated foam assembly.

Referring now to the drawings, in which like reference numerals are used to refer to the same or similar elements, FIG. 1 shows a laminated foam assembly generally designated 1 which is provided in accordance with the first step of the method of the present invention. The foam assembly includes a sheet of foam 11 which is pre-laminated with a sheet of fabric 13 on its bottom surface. The sheet of foam 11 and the sheet of fabric 13 are co-extensive.

Although polyurethane foam is preferred for foam sheet 11, any thermoplastic foam material can be used according to the present invention, and in fact any formable material can be used which is capable of being formed into a permanent yet resilient three-dimensional shape. The foam sheet 11 may also be a combination of formable materials, such as the combination of more than one different type of foam for example. The sheet of fabric 13 is preferably polyester spandex (e.g., 90% polyester, 10% spandex), but may be any other fabric that can be affixed to a compressible material.

Figure 2:
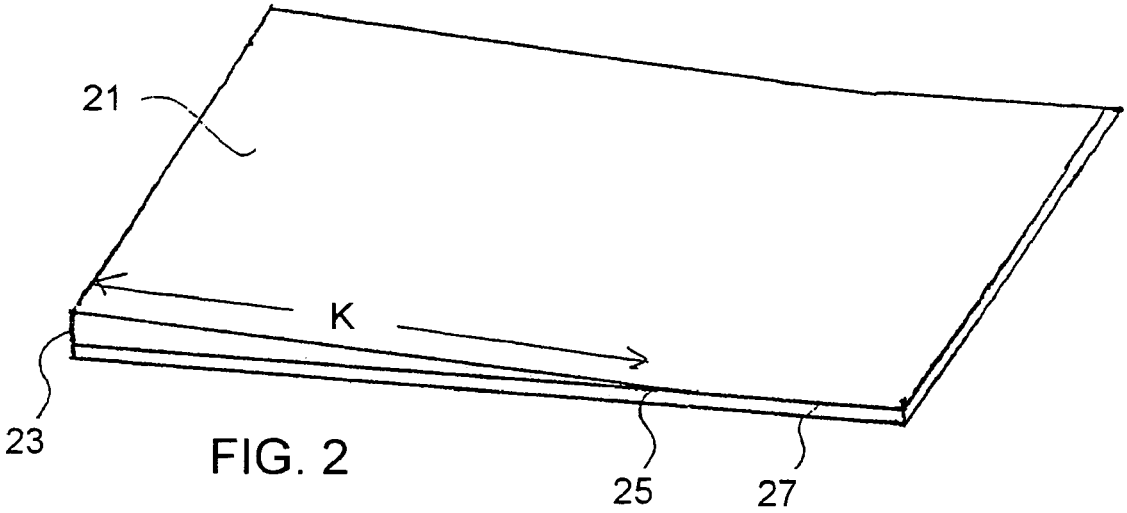
FIG. 2 is a top and front perspective view of the laminated foam assembly after the foam portion has been shaved.
Figure 3:
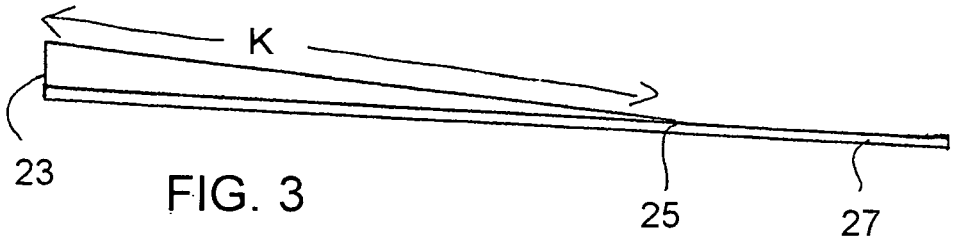
FIG. 3 is a side view of the laminated foam assembly after the foam portion has been shaved.

The sheet of foam 11 is then shaved to produce a shaved sheet of foam 21 which gradually and continuously becomes thinner from a thick end 23 to an end 25 having no foam along a length k, as shown in FIGS. 2–3. A small section 27 of the fabric 13 visibly extends beyond end 25.

The process is repeated to produce a second laminated foam assembly 1 with a shaved sheet of foam 21. The sections 27 of the laminated foam assemblies 1 are overlapped at 33 and sewn together to form a combined pre-form assembly 31 shown in FIG. 4.

Figure 4:
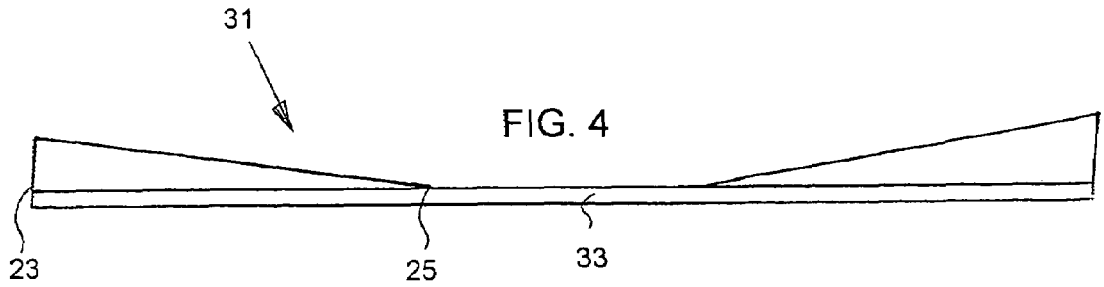
FIG. 4 is a side view of the pre-form assembly.
Figure 5:
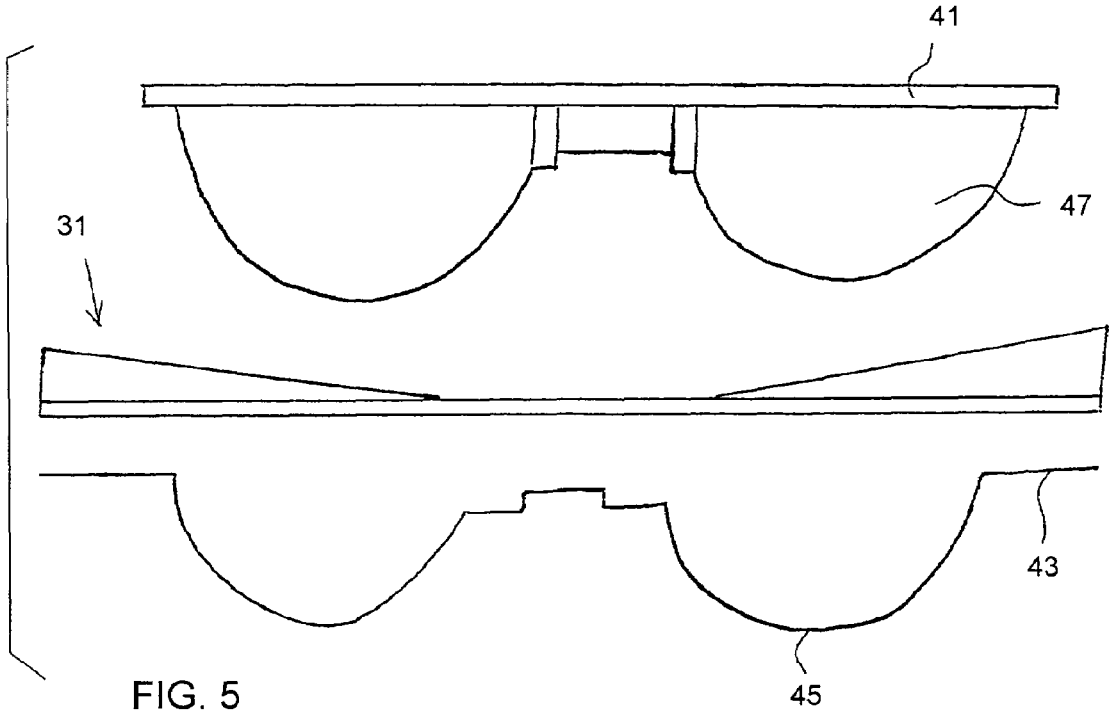
FIG. 5 is a schematic side view of the mold assembly for the molding of the pre-form assembly.

As illustrated in FIG. 5, the pre-form assembly 31 is then arranged in a mold having upper mold portion 41 and lower mold portion 43. The mold halves or portions 41 and 43 can be made of wood, plastic, metal or other suitable rigid material. Lower mold portion 43 contains a pair of recesses 45 and upper mold portion 41 contains cup-shaped male members 47. The upper mold portion 41 at a temperature of approximately 2000 Celsius presses the pre-form assembly 31 against the lower mold portion 43 at a temperature of approximately 190° Celsius. The male members 47 press the laminated foam assemblies of the pre-form assembly 31 into the pair of recesses 45 of the lower mold portion 43 under heat thus forming a sheet 51 containing a pair of pads 53, each having a neckline 55, a channeling 57, and an underarm 59 shown in FIG. 6 where the thick ends of the foam sheet of FIG. 4 are near the channeling 57 and underarm 59 at their ends spaced farthest from the neckline 55, and the foam becomes thinner toward the neckline 55 and there is no foam but only fabric at a location spaced from the neckline and up to the neckline.

The pair of pads are trimmed out of the sheet into two separate left and right pads 61 and 63. Glue is then sprayed on the inner or bottom side of the pads 61 and 63. The inner or bottom side is the side of the pad which will be closest to the skin when the foam is used in an article of clothing. A pair of stabilizers 71 are die cut into the shape shown in FIG. 7 and glue is sprayed onto opposite sides of the stabilizers 71. The stabilizers 71 are glued onto the inner sides of the respective pair of pads as shown in FIG. 8. The dotted line in FIG. 8 shows the upper border or edge of the stabilizer 71 which lies on inner side of the pad 61. Stabilizers 71 are flat rigid pieces of nylon used to give shape and provide lift to the pad.

Figure 9:
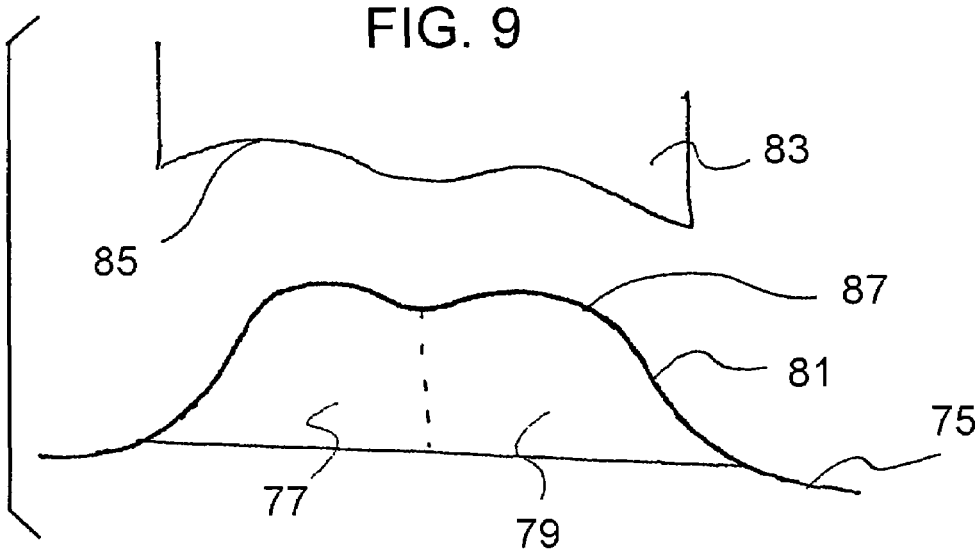
FIG. 9 is a schematic side view of the mold assembly for molding a second sheet of fabric.

Next, a second sheet of fabric 75, made from lycra or nylon, or a combination thereof (e.g., 72% nylon and 28% lycra), is molded between a lower mold portion 81 and an upper mold portion 83 shown in FIG. 9. The upper mold portion 83 has two recesses 85 and the lower mold portion 81 has a pair of apex areas 87 which are complementary to the recesses 85. The second sheet of fabric 75 is laid on the lower mold portion 81 such that it covers the entire lower mold portion 81 and is divided into a left side portion 77 and a right side portion 79. The second sheet of fabric 75 is molded at approximately 185° Celsius for approximately 120 seconds.

Figure 10:
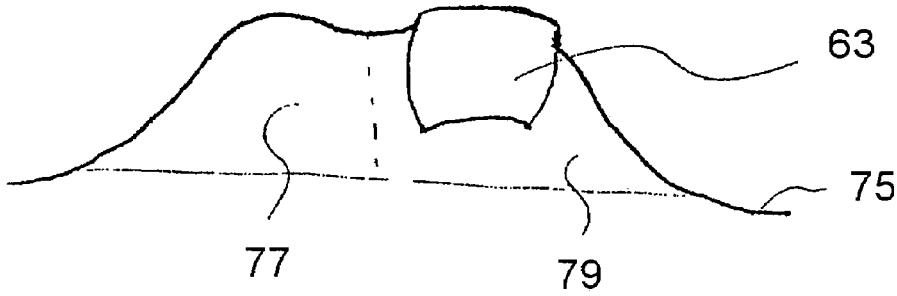
FIG. 10 is a side schematic view of a pad placed on the right side of the mold for being enclosed in a molded second sheet of fabric.
Figure 11:
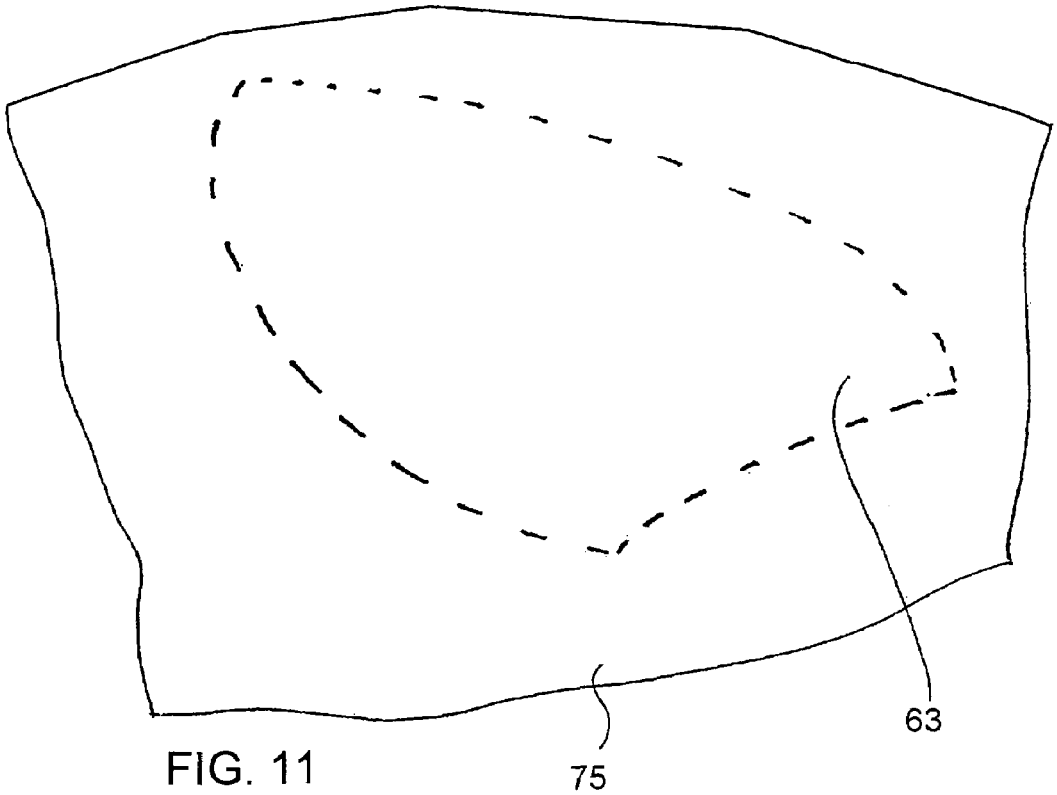
FIG. 11 is a drawing of the second sheet of fabric with dashed lines designation the area of the fabric that is trimmed around the enclosed pad.

Then, the right pad 63 is placed over the right side of the lower mold portion 81 as shown in FIG. 10. The portion of the fabric 75 covering the left side 77 of the lower mold portion 81 is folded over the top of the right pad 63. The right side portion 79 of the fabric, which now lies on the inner or bottom side of the right pad 63 is trimmed around the pad 63 edges designated by dashed lines in FIG. 11. The left side portion 77 of the fabric, which now lies on the outer or top side of the pad 63 is trimmed leaving approximately 1 cm. allowance of fabric past the edge of the pad 63.

The process is repeated wherein a second sheet of fabric 75 is molded between a lower mold portion 81 and an upper mold portion 83 shown in FIG. 9.

Figure 12:
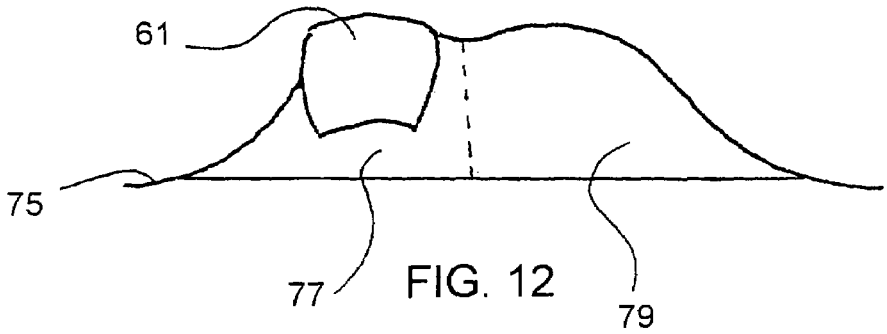
FIG. 12 is a side schematic view of a pad placed on the left side of the mold for being enclosed in a molded second sheet of fabric.

Then, the left pad 61 is placed over the left side 77 of the lower mold portion 81 as shown in FIG. 12. The portion of the fabric covering the right side 78 of the lower mold portion 81 is folded over the top of the left pad 61. The left side portion 77 of the fabric 75, which now lies on the inner or bottom side of the left pad 61 is trimmed around the pad edges. The right side portion 79 of the fabric 75, which now lies on the outer or top side of the pad 61 is trimmed leaving a small allowance of fabric past the edge of the pad 61, such as for example, a 1 cm. allowance.

Figure 13:
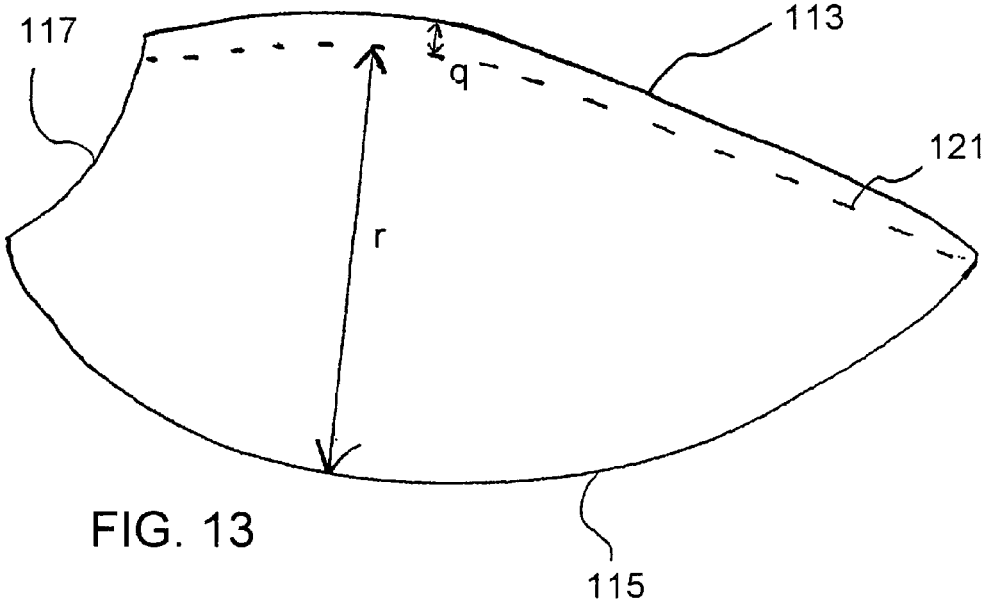
FIG. 13 is a diagram of the thickness distribution of the pad.

FIG. 13 shows a diagram of the thickness distribution of the final trimmed pad of the present invention. The final trimmed pad includes a neckline 113, a channeling 115, and an underarm 117. A dashed line 121 separates the pad into a portion having a length q near and along the neckline 113 which has only fabric. This portion containing only fabric corresponds to the location of the small section of fabric 27 that extends beyond the shaved foam 21 of the laminated foam assembly 1 in the pad pre-formation steps.

The remainder of the final trimmed pad has a portion of graduated thickness along a length r. The portion of graduated thickness has the thickest area at the channeling 115 of the pad and the thinnest area at the dashed line 121. The portion of graduated thickness corresponds to the shaved sheet of foam 21 made in the preformation steps which gradually became thinner from a thick end 23 to an end 25 having no foam. Thus the length r of graduated thickness of the final trimmed pad corresponds to the length k of the shaved sheet of foam 21 made in the pre-formation steps.

While a specific embodiment of the invention has been shown and described in detail to illustrate the application of the principles of the invention, it will be understood that the invention may be embodied otherwise without departing from such principles.

What is claimed is:

1. A pad for a breast covering garment comprising:

a fabric sheet having an upper neckline, a lower channeling and an underarm;

a foam sheet of compressible material adhered to the fabric sheet; and wherein a first portion of the pad arranged adjacent and along the upper neckline contains only fabric of the fabric sheet, and a remaining second portion of the pad arranged between said first portion and said lower channeling contains the compressible material of the foam sheet, the foam sheet having a thickest end at locations of the underarm and the channeling which are spaced away from the neckline, and the foam sheet becoming gradually and continuously thinner toward the neckline to a location that is near to, but still spaced from the neckline where the sheet of foam ends at the first portion of the pad.

2. A pad according to claims 1, wherein the compressible material of the sheet of foam is thermoplastic foam that is shaped by heat and pressure with the sheet of fabric to form the pad.

3. A pad according to claims 1, including a fabric stabilizer adhered to the sheets of fabric and foam on a surface of the pad meant to be adjacent a wearer's skin when a garment containing the pad is worn, the fabric stabilizer being spaced away from the neckline.

4. A pad according to claims 1, wherein the sheets of fabric and foam have inner surfaces that are adhered to each other, and outer surfaces, the pad including a fabric cover sheet over the outer surfaces of the sheets of fabric and foam.

5. A pad for a breast covering garment comprising:

an upper neckline side connected to a lower channeling side at a first end of the pad; and an underarm side arranged at a second end opposite the first end of the pad, the underarm side having a first end connected to the neckline side and a second end connected to the lower channeling side;

wherein the pad has a fabric portion adjacent and along the neckline side and a compressible foam material portion between said fabric portion and said lower channeling side, the compressible foam material portion having a continuous graduated thickness and being thinnest near the fabric portion with no compressible foam material in the fabric portion, and gradually and continuously thicker in a direction away from the fabric portion toward the underarm and channeling sides, the compressible foam material have a thickest end at the first end of the pad at locations of the underarm and channeling sides that are spaced farthest from the neckline side.

6. A pad according to claims 5, wherein the compressible foam material portion is thermoplastic foam that is shaped by heat and pressure with the fabric portion to form the pad.

7. A pad according to claims 5, including a fabric stabilizer adhered to the fabric and foam material portions on a surface of the pad meant to be adjacent a wearer's skin when a garment containing the pad is worn, the fabric stabilizer being spaced away from the neckline side.

8. A pad according to claims 5, wherein the fabric and foam material portions have inner surfaces that are adhered to each other, and outer surfaces, the pad including a fabric cover sheet over the outer surfaces of the fabric and foam material portions.

9. A pad comprising:

a neckline side with first and second ends;

an underarm side with top and bottom ends, the top end being connected to the first end of said neckline side; and a channeling side branching from the second end of said neckline and connecting to the bottom end of said underarm side;

wherein the pad has only a fabric portion adjacent and along the neckline side and a compressible material portion between said fabric portion and said channeling side, the compressible material portion having a continuously graduated thickness and being thinnest near the fabric portion and gradually and continuously thicker in a direction away from the fabric portion, the compressible material portion being thickest at the bottom end of the underarm side and at locations of the underarm and channeling sides that are spaced farthest from the neckline side.

10. A pad according to claims 9, wherein the compressible material portion is thermoplastic foam that is shaped by heat and pressure with the fabric portion to form the pad.

11. A pad according to claims 9, including a fabric stabilizer adhered to the fabric and compressible material portions on a surface of the pad meant to be adjacent a wearer's skin when a garment containing the pad is worn, the fabric stabilizer being spaced away from the neckline side.

12. A pad according to claims 9, wherein the fabric and compressible material portions have inner surfaces that are adhered to each other, and outer surfaces, the pad including a fabric cover sheet over the outer surfaces of the fabric and compressible material portions.

* * * * *